United States Patent [19]

Mizuno

[11] Patent Number: 4,621,509

[45] Date of Patent: Nov. 11, 1986

[54] COMBINATION LOCKING DEVICE HAVING REMOVABLE U-SHAPED RETAINING ROD

[75] Inventor: Toshinao Mizuno, Kasugai, Japan

[73] Assignee: Kabushiki Kaisha Saikousha, Kasugai, Japan

[21] Appl. No.: 662,159

[22] Filed: Oct. 18, 1984

[30] Foreign Application Priority Data

Oct. 20, 1983 [JP] Japan ..... 58-162537[U]

[51] Int. Cl.[4] ..... E05B 37/02

[52] U.S. Cl. ..... 70/26; 70/312

[58] Field of Search ..... 70/25, 26, 39, 287, 70/288, 312

[56] References Cited

U.S. PATENT DOCUMENTS 1,226,895 5/1917 Landeen ..... 70/26

1,383,317 7/1921 McAdoo ..... 70/26

FOREIGN PATENT DOCUMENTS 802395 6/1936 France ..... 70/26

*Primary Examiner*—Robert L. Wolfe

*Attorney, Agent, or Firm*—Oblon, Fisher, Spivak, McClelland & Maier

[57] ABSTRACT

A locking device in which retaining holes for fitting therein both end portions of a U-shaped retaining rod are formed in the outer periphery of a cylindrical body case with a combination lock attached integrally thereto, the cylinder lock being adapted to be unlocked by combining numerals thereon into a predetermined unlocking number, and a retaining piece for engagement and disengagement with and from retaining grooves formed in both end portions of the retaining rod is disposed within the body case, and when the combination lock is in an unlocked state, the retaining piece is moved out of engagement with the retaining grooves in a longitudinal direction of the body case by operation from the exterior of the case.

10 Claims, 7 Drawing Figures

COMBINATION LOCKING DEVICE HAVING REMOVABLE U-SHAPED RETAINING ROD

BACKGROUND OF THE INVENTION (1) Field of Art

The present invention relates to a locking device for linking and locking, for example, an outdoors parked motorcycle between it and a building, including a tree, a fence or the like, to prevent the motorcycle from being stolen.

(2) Prior Art

Light vehicles, for example, bicycles and motorcycle parked outdoors are provided with a locking device for preventing the rotation of their wheels or for locking their handles. But, since such light vehicles per se are of relatively light weight, they are sometimes stolen by being carried away in a locked state.

As a countermeasure there has been proposed in which a chain is stretched between the frame or other portion of a bicycle or a motorcycle and a building and it is locked with a lock. But, this proposed method has the drawback that the chain is easily cut with a chain cutter, thus permitting the bicycle or motorcycle to be stolen. In an effort to overcome this drawback, if a solid locking device capable of linking and locking a motorcycle or the like between it and a building is fabricated, the theft preventing object will indeed be attained, but the operation of the locking device, including linking with a building and locking operation, will become troublesome. As a result, the possessor of such solid locking device will no longer use it, and after all the motorcycle will be stolen.

SUMMARY OF THE INVENTION

According to the present invention there is provided a locking device in which both end portions of a U-shaped retaining rod are fitted in retaining holes formed in a cylindrical body case, engageably and disengageably through a reciprocative motion in a perpendicularly intersecting state, and the retaining rod is locked to and unlocked from the body case by means of a combination lock which unlocks the retaining rod by combining and setting numerals to a predetermined number, whereby not only the theft preventing effect can be attained by also the device structure can be made simpler and easier to handle.

The gist of the present invention resides in a locking device in which, as shown in FIG. 1, retaining holes 4 for fitting therein both end portions of a U-shaped retaining rod 3 are formed in the outer periphery of a cylindrical body case 2 with a combination lock 1 attached integrally thereto, which combination lock 1 is adapted to be unlocked, by combining and setting numerals thereon into a predetermined unlocking number, and a retaining piece 6 for engagement and disengagement with and from retaining grooves 5 formed in both end portions of the retaining rod 3. To achieve an unlocked state, the retaining piece 6 is moved out of engagement with the retaining grooves 5 in a longitudinal direction of the body case 2 by operation from the exterior of the case 2.

DESCRIPTION OF THE PREFERRED EMBODIMENT

Construction of a locking device according to a first embodiment of the present invention will be described below with reference to FIGS. 2 to 5.

Figure 1:
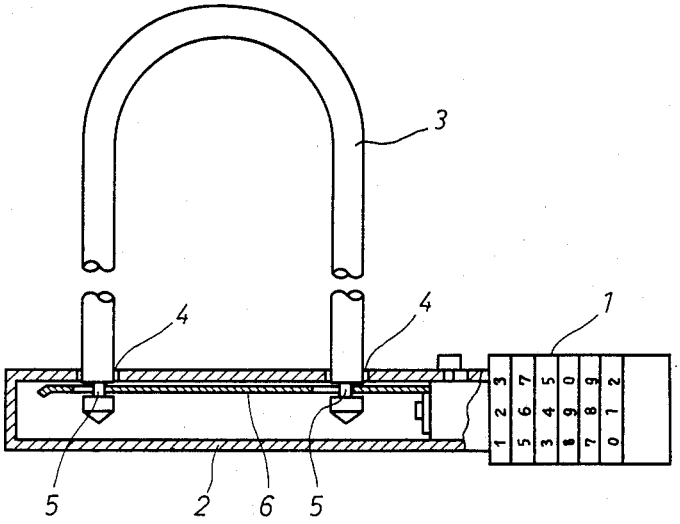
FIG. 1 is an entire construction diagram of the present invention.
Figure 2:
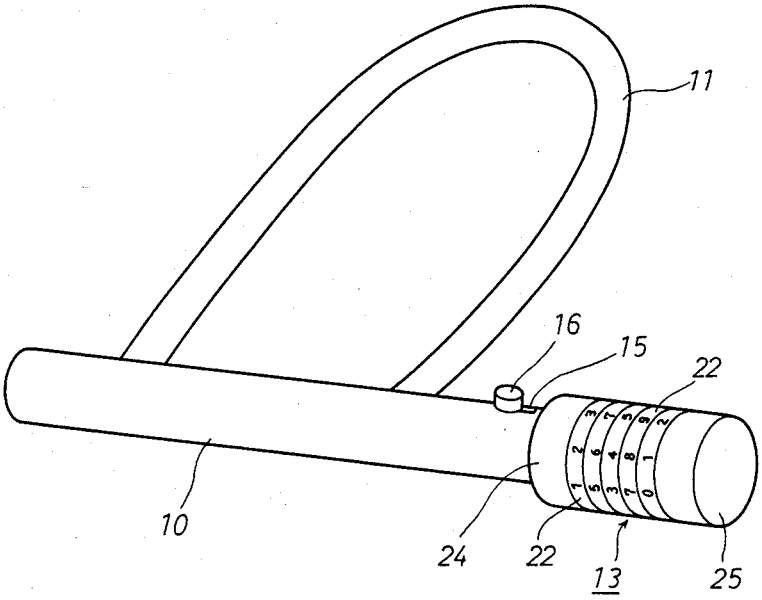
FIG. 2 is a perspective view of a locking device according to an embodiment of the present invention.

As shown in FIG. 2, retaining holes 12 for fitting therein both end portions of a U-bent retaining steel rod 11 are formed in the outer periphery of a cylindrical body case 10 made of steel, and a combination lock 13 is integrally attached to one end portion of the body case 10, which case serves as an outer combination of the cylinder lock 13.

Figure 4:
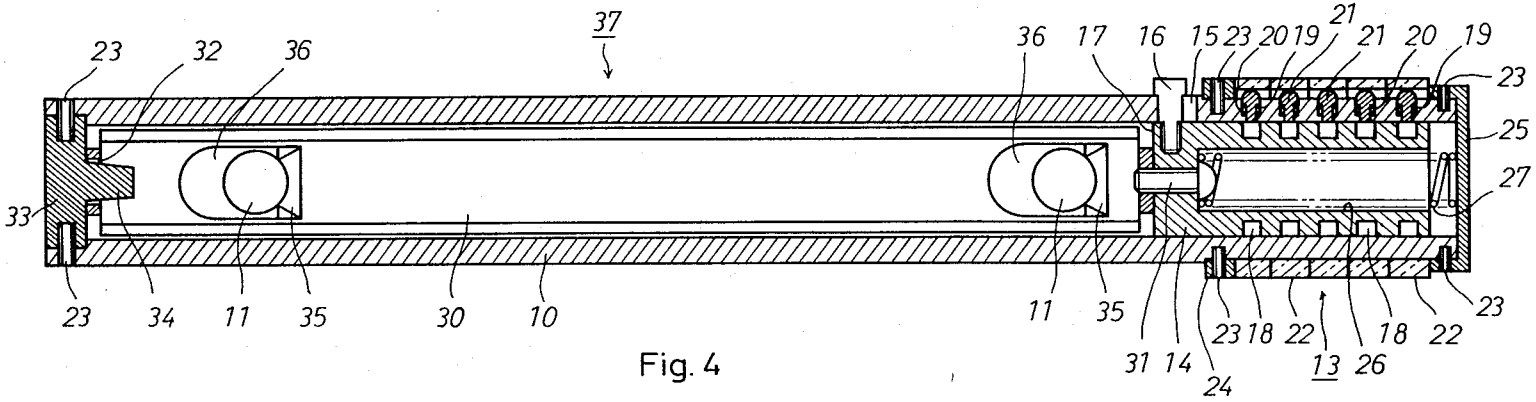
FIG. 4 is a longitudinally sectional bottom view thereof.
Figure 5:
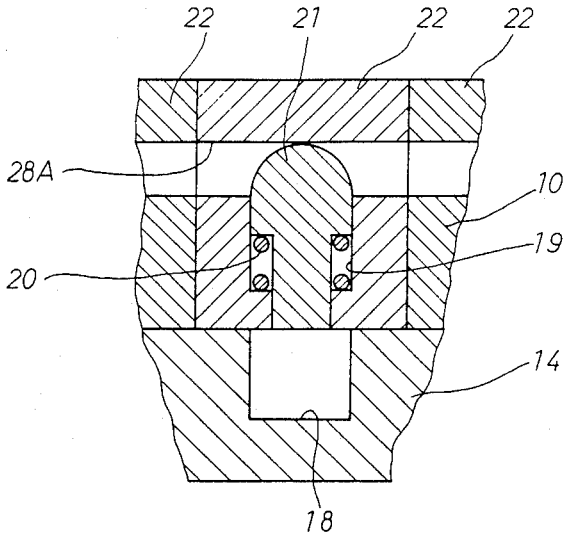
FIG. 5 is a detail view of a principal portion thereof.

More specifically, as shown in FIG. 4, an inner combination 14 of the cylinder lock 13 is inserted into one end portion of the body case 10 as an outer combination of the cylinder lock 13, and a knob 16 is attached to the inner cylinder 14 with a screw 17 through a long hole 15 formed in the body case, 10, thereby restricting the amount of a longitudinal movement of the inner cylinder 14, whose leftmost position is a locking position and rightmost position is an unlocking position. Further, as shown in FIG. 5, stepped pin holes 19 are formed in the outer periphery of the body case 10 longitudinally in a row and at the same intervals as ring-like retaining grooves 18 which are formed in the inner cylinder 14 longitudinally at equal intervals, and rivet-like retaining pin 21 urged toward the outer periphery with a spring 20 is fitted reciprocatably in each of the pin holes 19.

On the outer periphery of the body case 10, as shown in FIG. 4, are mounted number rings 22 of the combination lock 13 in such a form as to prevent jumping out of the retaining pins 21, said number rings being rotatably mounted yet being restricted in their longitudinal movement on the body case 10 between a fixed ring 24 and one end cap 25, the fixed ring 24 being fixed to the body case 10 with caulking pins 23. Further, between a bottomed bore 26 formed in the inner cylinder 14 and one end cap 25 is inserted a spring 27 which urges the inner cylinder 14 toward the left-hand locking position in FIGS. 3 and 4.

Figure 3:
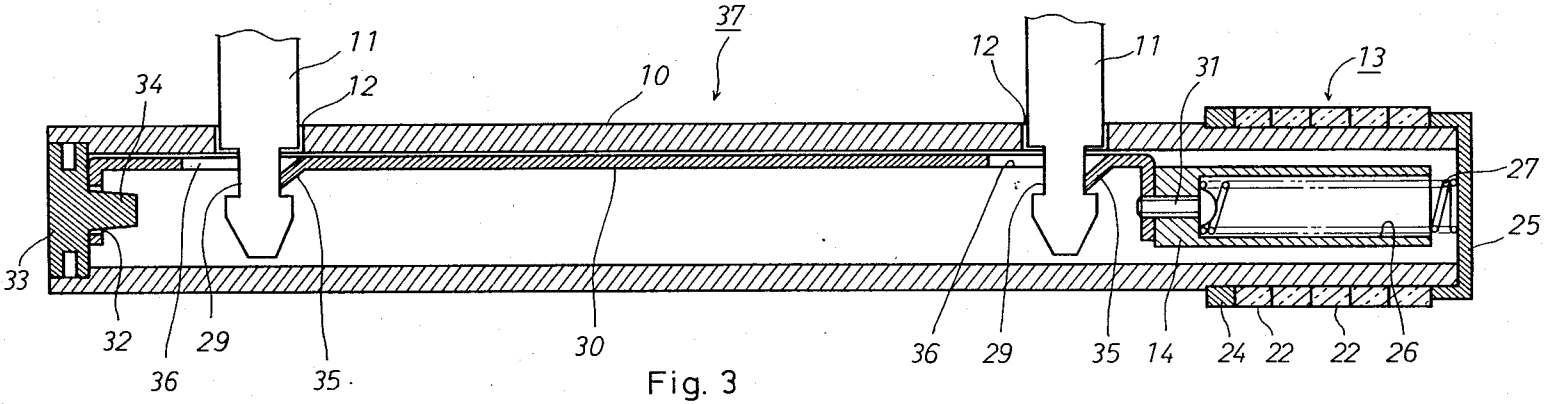
FIG. 3 is a longitudinally sectional front view thereof.
Figure 6:
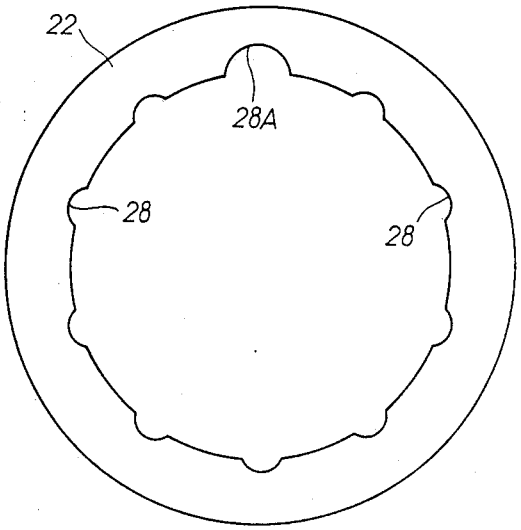
FIG. 6 is a front view of a number ring 22 used in the locking device.

As shown in FIG. 6., notches 28 are formed in the inner periphery of each number ring 22 in positions corresponding to numerical positions of the number ring, so under the construction described above, when the heads of the retaining pins 21 get in the largest notches 28A formed in the inner peripheries of the number rings 22 in positions corresponding to unlocking numerals on the combination lock 13, the end portions of the retaining pins 21 which have been engaged with the retaining grooves 18 of the inner cylinder 14 get out of those retaining grooves and therefore the inner cylinder 14 can be moved from the locking position of the combination lock 13 to the right-hand unlocking position thereof in FIGS. 3 and 4 against the biasing force of the spring 27 by operation of the knob 16.

In the body case 10 with the combination lock 13 thus attached thereto is disposed a retaining piece 30 for engagement with ring-like retaining grooves 29 formed in both end portions of the retaining rod 11 inserted in the retaining holes 2. The retaining piece 30 is fixed at one end thereof to the inner cylinder 14 of the combination lock 13 with a caulking pin 31, while the other end portion thereof is formed with a guide hole 32, which guide hole is loosely fitted on a projection 34 and is guided in this loosely fitted state, the projection 34 being formed on the other end cap 33 fixed to the body case 10 with caulking pins 23. The retaining piece 30 is formed with retaining pawls 35 for engaging the retaining grooves 29 of the retaining rod 11 when the inner combination 14 of the cylinder lock 13 is in the locking position thereby preventing the rod 11 from coming off the retaining holes 12, and also formed with long holes 36 for disengaging the retaining pawls 35 from the retaining grooves 29 when the inner cylinder 14 is in the unlocking position thereby permitting the retaining rod 11 to be pulled out of the retaining holes 12.

The following description is now provided about the operation of this embodiment.

In a locking device 37 constructed as above, for example, in the case of linking and locking a motorcycle to a roadside tree, numerals on the number rings 22 of the combination lock 13 are combined into an unlocking number to unlock the cylinder lock 13, and in a removed state of the retaining rod 11 from the body case 10, the retaining rod 11 is fitted over the roadside tree through its U-shaped portion and brought into contact with the frame of the motorcycle parked along the road side tree, then the both end portions of the retaining rod 11 are inserted into the retaining holes 12 of the body case 10, whereupon the retaining grooves 29 of the rod 11 come into engagement with the retaining pawls 35 of the retaining piece 30. In this state, if the set number is rendered uncombined by rotating any number ring 22, then any of the retaining pins 21 engages the retaining groove 18 of the inner cylinder 14 and cooperates with the retaining piece 30 to prevent the inner cylinder 14 from moving toward the right-hand unlocking position in FIGS. 3 and 4, whereby the locking between the body case 10 and the retaining rod 11 is ensured, that is, the motorcycle is firmly linked to the roadside tree through the locking device.

In this locked state, there is no fear of breakage of the body case 10 and the retaining rod 11 because both are formed of steel, and consequently it is not likely at all that the motorcycle as locked will be carried away. In the locking device 37, moreover, the U-shaped retaining rod 11 is symmetrical right and left to eliminate the affinity at the time of insertion of the end portions of the retaining rod 11 into the retaining holes 12 of the body case 10, that is, all that is required is merely axially inserting the end portions of the rod 11 regardless of on which side each end portion is positioned. Further, the unlocking operation does not require the use of any special key; it can be done by merely combining numerals on the combination lock 13 into a predetermined unlocking number, then moving the knob 16 and in this state pulling out the retaining rod 11 straight from the retaining holes 12. Thus, the locking and unlocking operations can be effected very easily. Consequently, the locking device 37 is put to use whenever necessary without giving any troublesome impression to its user, whereby the motorcycle is sure to be prevented from being stolen except exceptional cases. If the retaining rod 11 is not symmetrical right and left, it is necessary to select the end portions respectively associated with the right and left retaining holes 12 of the body case 10, and thus the locking operation is troublesome.

Figure 7:
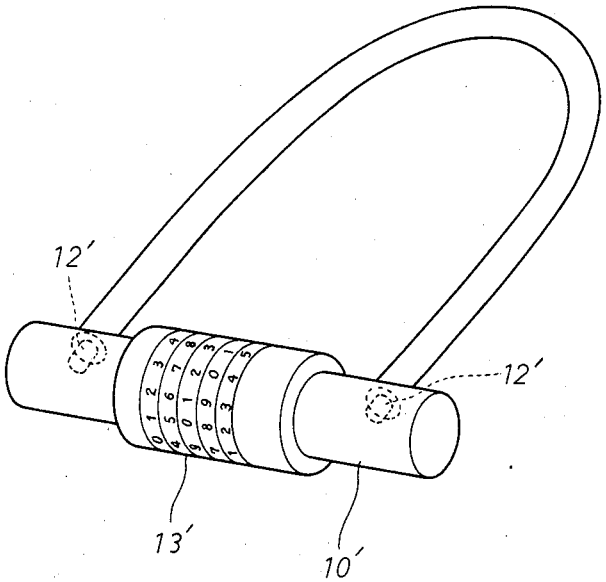
FIG. 7 is a perspective view of a locking device according to another embodiment of the present invention.

Although in the above embodiment the combination lock 13 is attached to an end portion of the body case 10, a combination lock 13' may be attached to an intermediate portion between retaining holes 12' of a body case 10', as shown in FIG. 7, whereby not only the body case 10' can be made shorter but also the numbering and other operations of the combination lock 13' can be done more easily.

What is claimed is:

1. A locking device comprising:

a combination lock comprising a plurality of number rings bearing numerals thereon, said number rings comprising means for unlocking said combination lock when they are moved to combine said numerals into a predetermined unlocking number;

a U-shaped retaining rod provided at both end portions thereof with retaining grooves;

a cylindrical body case mounted integrally with the combination lock, the cylindrical body case having retaining holes for insertion therein of both end portions of the retaining rod;

a retaining piece disposed in said body case and mounted for limited reciprocal longitudinal movement therein between a locking position within the body case and an unlocking position within the body case, said retaining piece comprising means for lockingly engaging and disengaging said grooves of the retaining rod when said retaining piece is in said locking and unlocking positions, respectively; and means manually operable from the exterior of the body case for moving the retaining piece into the unlocking position.

2. A locking device according to claim 1, wherein the combination lock comprises an outer cylinder formed integrally with the body case.

3. A locking device according to claim 1, wherein the combination lock is mounted on the body case in a position intermediate between both said retaining holes.

4. A locking device according to claim 1, wherein both end portions of the U-shaped retaining rod are symmetrical right and left.

5. A locking device according to claim 2, wherein the combination lock further comprises an inner cylinder inserted reciprocatably into an end portion of the outer cylinder of the combination lock on the side of the body case, said manually operable means comprising a knob affixed to the inner cylinder by a screw through a long hole formed in the body case, thereby restricting the amount of longitudinal movement of the inner cylinder.

6. A locking device according to claim 5, wherein the body case is provided in its outer periphery with stepped pin holes formed longitudinally in a row at the same intervals as ring-like retaining grooves which are formed in the inner cylinder longitudinally at equal intervals, with a rivet-like retaining pin being reciprocatably fitted in each said pin hole, the pin being urged in an outer peripheral direction by means of a spring.

7. A locking device according to claim 6, wherein said number rings of the combination lock are mounted on the outer periphery of the body case in such a form as to prevent jumping out of the retaining pins, said number rings being rotatably mounted and being restricted in their longitudinal movement on the body case between a fixed ring and a first end cap, the fixed ring being fixed to the body case with caulking pins, the combination lock further comprising a spring for urging the inner cylinder toward a locking position, said spring being inserted between a bottomed bore formed in the inner cylinder and the first end cap.

8. A locking device according to claim 7, wherein, when the heads of the retaining pins get in largest notches formed in the inner peripheries of the number rings in positions corresponding to unlocking numerals on the combination lock, the end portions of the retaining pins, which have been engaged with the retaining grovoes of the inner cylinder, get out of the retaining grooves, thus permitting the inner cylinder to be moved from said locking position to an unlocking position thereof against the biasing force of said spring inserted in said bottomed bore by operation of said knob.

9. A locking device according to claim 1, wherein the retaining piece for engagement with the ring-like retaining grooves formed in both end portions of the retaining rod inserted in the retaining holes is fixed at one end thereof to an inner cylinder of the combination lock by means of a caulking pin, while the other end portion thereof is formed with a guide hole, the guide hole being loosely fitted on a projection and guided thereby in this loosely fitted state, the projection being formed on a second end cap fixed to the body case with caulking pins.

10. A locking device according to claim 1, wherein the retaining piece is formed with retaining pawls for engaging the retaining grooves of the retaining rod when an inner cylinder of the combination lock is in a locking position, thereby preventing the rod from exiting the retaining holes, said retaining piece being formed with long holes for disengaging the retaining pawls from the retaining grooves when the inner cylinder is in an unlocking position, thereby permitting the retaining rod to be pulled out of the retaining holes.

* * * * *